US008286720B1

(12) United States Patent
Moyer

(10) Patent No.: US 8,286,720 B1
(45) **Date of Patent: *Oct. 16, 2012**

(54) SPARK ARRESTOR FOR PROCESSING METAL WORKPIECES

(76) Inventor: Dennis Moyer, Cooperstown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/229,882

(22) Filed: Sep. 12, 2011

Related U.S. Application Data

(63) Continuation-in-part of application No. 13/013,371, filed on Jan. 25, 2011.

(51) Int. Cl.
*A62C 8/00* (2006.01)
*A47G 5/04* (2006.01)

(52) U.S. Cl. ..... 169/48; 169/91; 160/351; 451/455

(58) Field of Classification Search ..... 169/45, 169/48–50, 91; 160/351, 405; 451/451, 451/455; 102/303
See application file for complete search history.

(56) References Cited

U.S. PATENT DOCUMENTS 2,325,506 A * 7/1943 Grace ..... 206/223
2,410,306 A * 10/1946 Romberg ..... 52/82
2,491,957 A 12/1949 Dilley
2,911,038 A 11/1959 Frommelt
4,178,724 A 12/1979 Bruno
4,622,781 A 11/1986 Vieau et al.
5,191,841 A 3/1993 Gilbert
5,794,707 A * 8/1998 Alhamad ..... 169/69
5,854,461 A 12/1998 Sorenson

* cited by examiner

*Primary Examiner* — Darren W Gorman
(74) *Attorney, Agent, or Firm* — Eckert Seamans Cherin & Mellott, LLC; Arnold B. Silverman

(57) ABSTRACT

A spark arrestor for processing metal workpieces includes an annular body having an upper end wall provided with a first opening and a lower end wall provided with a second opening. The annular body has a pair of generally aligned, circumferentially offset, downwardly open first recesses, each structured to be received over at least a portion of the metal workpiece. Each recess may have having a plurality of downwardly extending first shield elements. Lateral surfaces of the annular body disposed between the downwardly open first recesses have a pair of lateral second recesses which have a plurality of second shield elements extending downwardly therefrom. A torch receiving opening is provided in the annular body to facilitate insertion of the torch. The upper end wall first opening preferably has a grid structure to resist outward migration of sparks and flames from the interior of the spark arrestor.

15 Claims, 7 Drawing Sheets

SPARK ARRESTOR FOR PROCESSING METAL WORKPIECES

CROSS REFERENCE TO RELATED APPLICATION

This application is a continuation-in-part of U.S. patent application Ser. No. 13/013,371 filed Jan. 25, 2011, entitled SPARK ARRESTOR FOR PROCESSING RAILROAD RAILS.

BACKGROUND OF THE INVENTION

1. Field of the Invention

The present invention relates to a spark arrestor and, more specifically, it relates to a spark arrestor which may be employed in combination with a torch used to process portions of a metal workpiece in the process of cutting, heating or welding the metal workpiece while focusing upon resisting undesired spreading of flames or sparks to adjacent people or material in order to minimize or eliminate the risk of employee burns and fires.

2. Description of the Prior Art

In connection with conventional railroad operations, it is periodically necessary to remove railroad rails which have become worn or otherwise deteriorated and are not serviceable with the degree of safety required. It is conventional to use a cutting torch to cut portions of the upper rail underlying the upper flange approximately every forty feet along the length of the rail.

When cutting rail, the rail is first measured with a measuring wheel 40 feet in length and marked with paint stick, and making a mark thereafter every 40 feet. Then the cutting torch is used to make the cuts. With the tip of the torch pointing straight down on top of the rail head, a cut is started and made directly across the shortest exit out of the other side of the rail head. The cut is made only through the head of the rail and starting into the web of the rail (directly under center of the head) approximately ¼ of an inch. Total length of this cut is less than 3 inches. It takes less than 15 seconds for an experienced torch man to make the cut.

If the rail is laying on its side, the person operating the cutting torch may choose to cut through ½ of the rail head side pointing up about an inch long and ½ through the base side pointing up (about 3 inches long) or may cut all the way across the base (about 6 inches long) or all the way across the head, whatever is allowed by the terrain. A cut will be made every 40 feet until the end is reached. All work is performed while using on track transportation, a high rail truck is used to haul the tools needed, and this truck may also be used to travel on railroad access roads to drive along side of the work when conditions are permitting.

The removal of the rail involves a high rail boom truck. This is a straight truck or a tractor trailer (semi) which hauls the rail and has a knuckle boom loader mounted on it to pick up the rail. The boom truck is a straight truck and cannot haul 40 foot rail. It, therefore, must be accompanied by a high rail cart. This cart has a 16-18 foot tow bar which allows it to be far enough from the truck for an overhang of approximately 8-10 feet. The overall picture would be that the cart is about 16 feet in length and an even length will hang over the front as what will hang over the rear of the cart (centered). This truck has remote control operation from the loader seat and can be driven from this seat while on the rail and working. The operator reaches down close to the cut on the rail and lifts approximately 10 to 18 inches until the rail snaps the rest of the way through from the torch cut, then sets it back on the ground and lets loose of it to reposition to load the rail on the cart.

Railroad ties are not replaced in this process. The ties are not fire resistant and are not treated to be fire resistant. They sometimes do catch fire. Sparks and flames may fly up into the tracks.

There is also a need for such a spark arrestor in connection with additional operations wherein a torch emitting flames is employed cut a metal workpiece, as by severing a portion from an elongated piece of the same or to cut openings or make other cuts of the same, or to preheat the workpiece which will be subjected to subsequent processing such as welding, for example.

While prior efforts have been made to deal with this serious problem of flames and sparks, to-date none have provided a successful, economically feasible, technically effective solution.

U.S. Pat. No. 2,911,038 discloses a flexible, self-supporting welding shield which is structured to be placed around the area of activity and resist sparks, flashes and hot particles. The structure includes an inner mesh 5, a pair of fabric elements 2,3 and support elements 10. Fastening rings 7 are provided to secure the elements in the desired position. The structure is not suitable for use in the present invention's environment, as there is no way of providing seals underlying the lower edge of the shield. As a result, sparks and flames could emerge therefrom. Also, there is no way of providing continuity of protection, as there is no position in which a rail could pass through the structure.

Japanese Abstract JP2001239269 discloses a spark shield sheet which is said to be freely bendable and consists of wire gauze 3 in combination with a flame resistant sheet 2 along with metal fittings 4. In the brief English language translation, it is stated that the flame resistant sheet may be folded into a box shape. While this might provide an enclosure of sorts, for reasons stated hereinbefore, it would not be suitable to solve the problem which the present invention has solved in respect of use of a flame torch to cut portions of a railroad rail which are to be removed.

U.S. Pat. No. 2,491,957 discloses a type of shield which is said to be transparent or translucent and is to be positioned over industrial equipment and secured in place by permanent magnets. While it does disclose the concept of shielding of sparks, it is in an industrial environment and provides a shield which would not be suitable for the problem solved by the present invention.

U.S. Pat. No. 5,854,461 discloses a welding shield adapted to reduce the amount of heat to which a welder's hand is exposed.

U.S. Pat. Nos. 4,622,781, 4,178,724 and 5,191,841 relate merely to mobile rail grinding equipment.

In spite of the foregoing disclosures, there remains a very real and substantial need for a spark arrestor capable of effectively resisting flames and sparks emerging from the shield during torch operations on a metal workpiece.

SUMMARY OF THE INVENTION

The above described problems have been solved by the present invention which provides a spark arrestor for salvaging railroad rails. An annular body has an upper end wall provided with a first opening and a lower end wall provided with a second opening. The annular body has a pair of generally aligned, circumferentially offset, downwardly open recesses which are structured to receive a portion of a railroad rail. Each of the recesses is operatively associated with a plurality of downwardly extending shield elements which extend downwardly beyond the upper surface of the rail. An opening is provided in the annular body for introduction of a cutting torch into the interior of the spark arrestor. Lateral portions of the annular body disposed between the downwardly open recesses have a second plurality of downwardly depending shield elements which serve to resist passage of flames and sparks thereunder. This results in substantially complete circumferential protection against undesired flame and spark escape from the interior of the spark arrestor during rail cutting operations.

It is an object of the present invention to provide a spark arrestor for use in processing metal workpieces while minimizing undesired escape of flames and sparks.

The spark arrestor structure described in the next proceeding paragraph may also be employed for a wide variety of uses other than railroad rails, in order to resist potential injury or damage to property resulting from sparks or flames created by the torch during the operation on a metal workpiece. For example, an elongated workpiece or plurality of workpieces, such as metal extrusions, said steel rods or any similar articles may be cut by the torch into a plurality of pieces of a desired length by cutting the elongated metal workpiece through the use of the torch. In another embodiment, the torch may be used to cut portions out of a workpiece, such as creating an opening in the workpiece without severing it from the parent stock. It may also be employed advantageously when workpieces are to be preheated.

If desired for certain activities, the spark arrestor may be employed without one or more of the shield elements. While such an embodiment will not provide the extent of protection as occurs with the use of such shield elements, in certain instances such as where the process will be practiced in an area where there is no significant amount of flammable material nearby and there is no great exposure for workers.

It is a further object of the present invention to provide such apparatus which is readily portable and may be moved easily from one rail processing operation to another.

It is yet another object of the present invention to permit direct viewing of the torch through a safety grid in the upper surface of the apparatus during the entry, cutting and removal of the torch.

It is another object of the present invention to substantially reduce or eliminate burn hazards to workmen in the immediate area, and the risk of fire due to vegetation, railroad ties and other materials which could be damaged by exposure to flames or sparks.

It is yet another object of the present invention to provide such a system which is economical to create and employ and does not require extensive training of individuals who will be using the same.

These and other objects of the invention will be more fully understood from the following description of the invention on reference to the illustrations appended hereto.

DESCRIPTION OF THE PREFERRED EMBODIMENTS

As employed herein, the term "spark arrestor" means a shield which resists passage of flames or sparks therethrough or thereunder.

As employed herein, the term "processing railroad rails" shall include cutting of rails, welding of rails and preheating of rails.

As employed herein, the term "metal workpiece(s)" means a workpiece which is to be subjected to cutting or welding or preheating action of a torch and shall expressly include, but not be limited to, elongated metal articles which are to be cut into pieces, metal articles which are to have portions removed, metal articles which are to be subjected to further processing.

Referring to FIGS. 1 through 4, there is shown the apparatus of the present invention 2 positioned over a railroad rail 5 which is in its operating position spaced from a parallel railroad rail 6 by a plurality of railroad ties, such as 8,10,12, for example.

Figure 5:
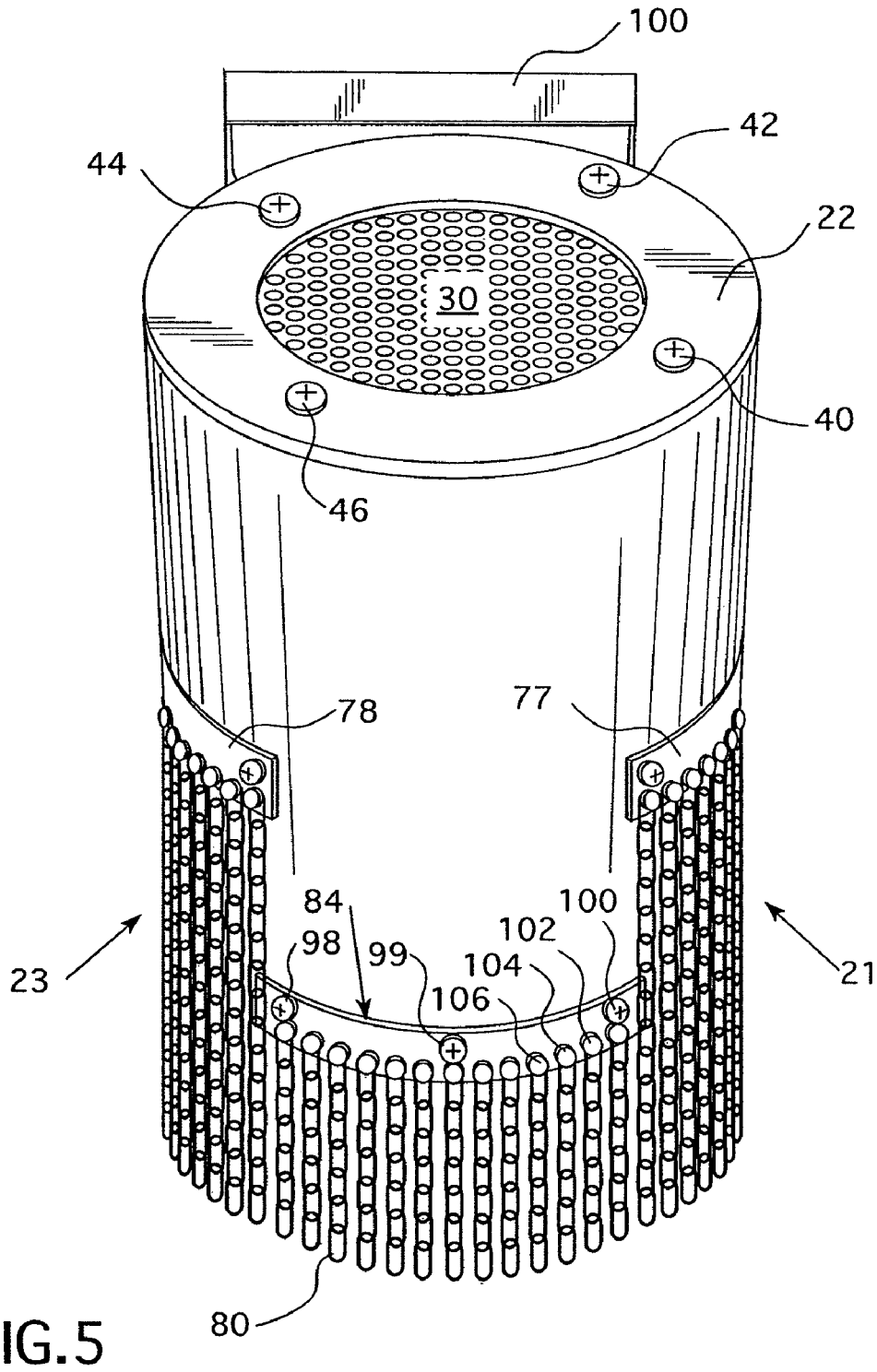
FIG. 5 is a perspective view showing the opposite side of the apparatus of the invention from that shown in FIG. 4.
Figure 6:
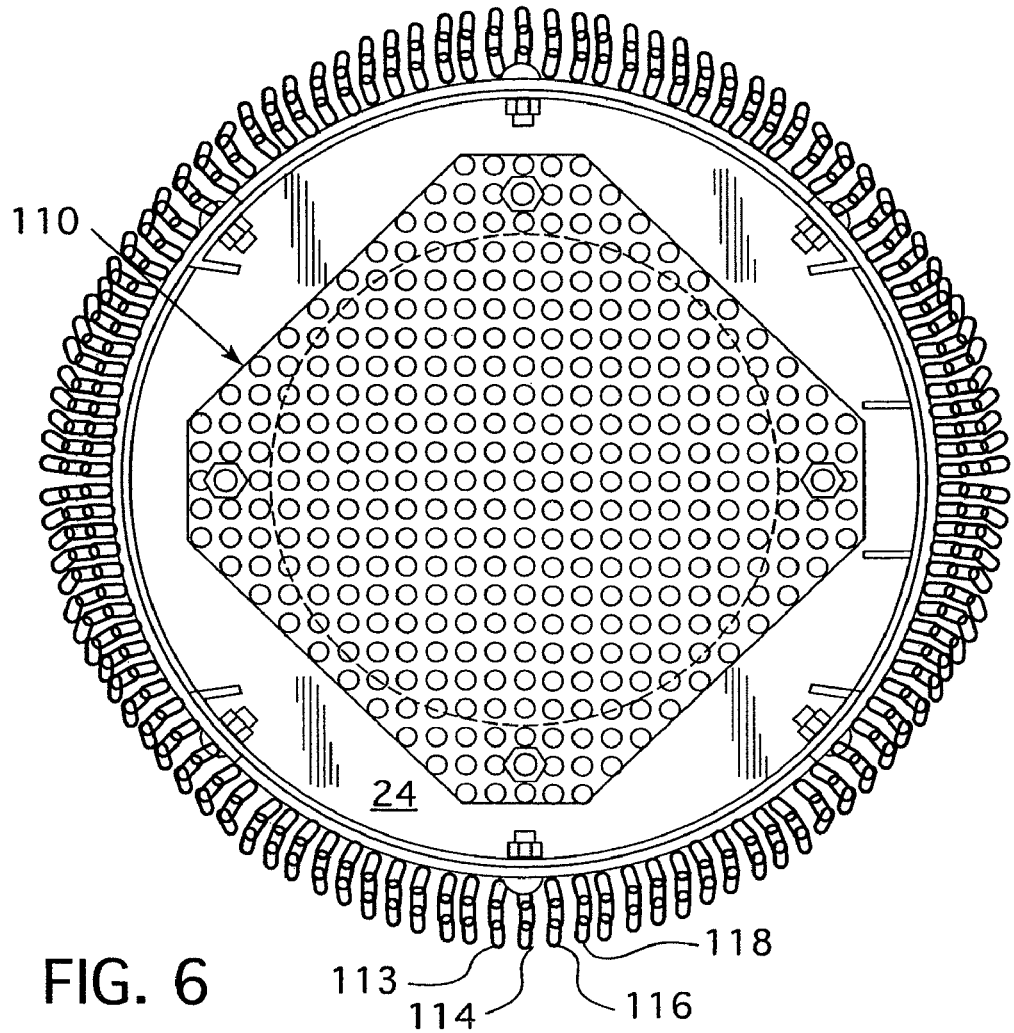
FIG. 6 is a bottom plan view of an embodiment of the apparatus of the present invention.

The spark arrestor has a generally annular body with an upper end wall 22 (FIG. 5) and a lower end wall 24 (FIG. 6). The upper end wall 22 has a grill 30 which, in the form shown, has a generally circular exposed portion secured to the upper end wall 22 which has a generally circular outer configuration, by any suitable means, such as screw fasteners 40,42, 44,46, for example. The grill 30 in a preferred form may comprise at least one stainless steel grid. Grill 30 in the upper end wall 22 permits one employing the torch in a manner to be described hereinafter, to view the position of the torch with respect to the rail, without exposing himself or herself to the risk of flames or sparks emerging from the upper end wall.

Figure 3:
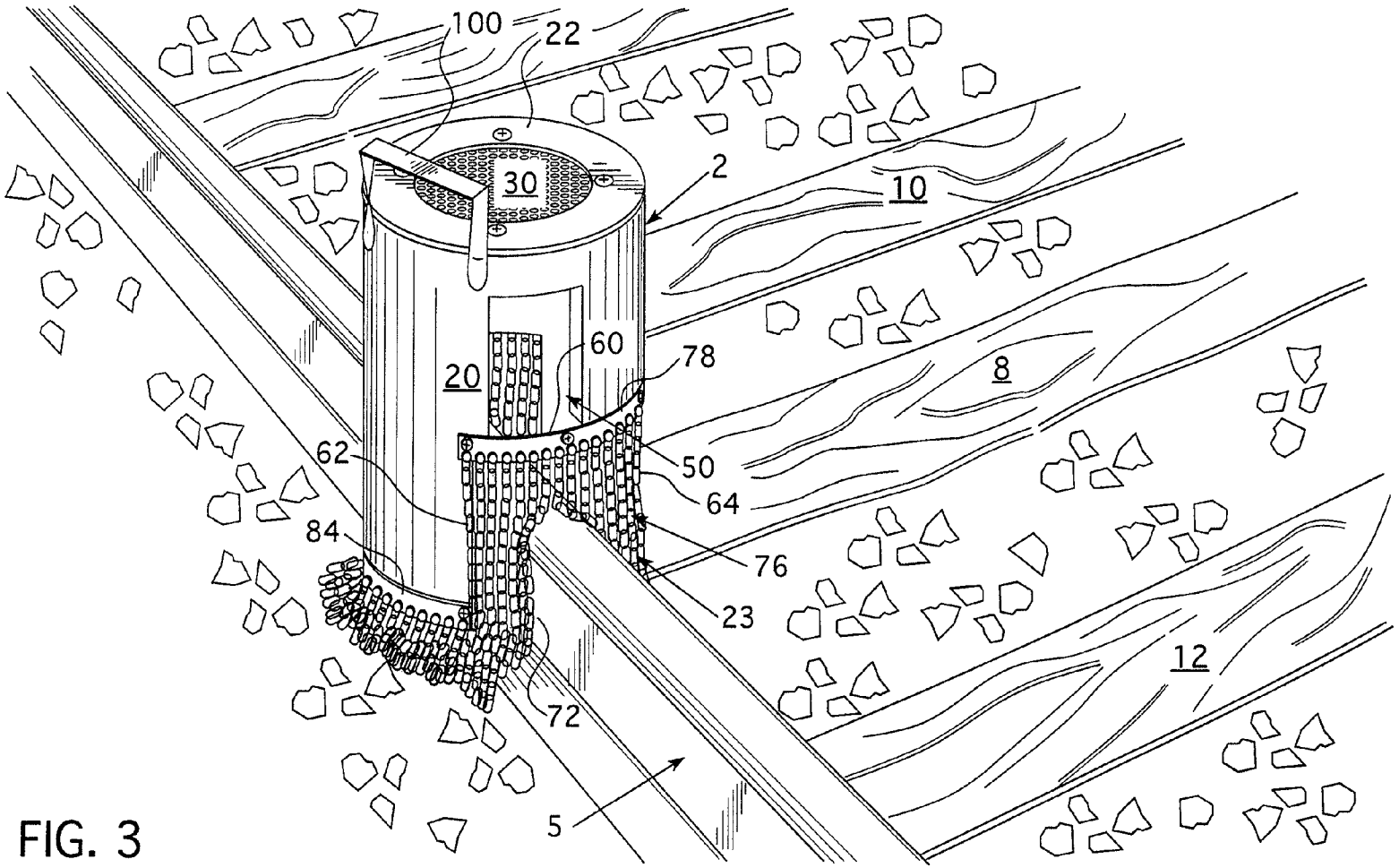
FIG. 3 is a perspective view showing a rear portion of the apparatus of the present invention with its first plurality of shield elements and a portion of one lateral surface with its second plurality of shield elements.

As shown in FIG. 3, a generally vertically oriented, elongated opening 50 is provided in one of the portions of the annular body 20, which overlies the rail. This opening 50 is structured to permit the cutting torch to enter the apparatus overlying the rail 5 and to be viewed from above through grill 30 during the cutting operation, In general, the cutting of the rail when it is in a vertical position, as in FIGS. 1 and 3, will take place through the upper flange which is the head of the rail and through the underlying rail web. If the rail is on its side, the cut will be made at the highest portion of the rail. Cuts will generally be made along the rail about every 40 feet.

Figure 4:
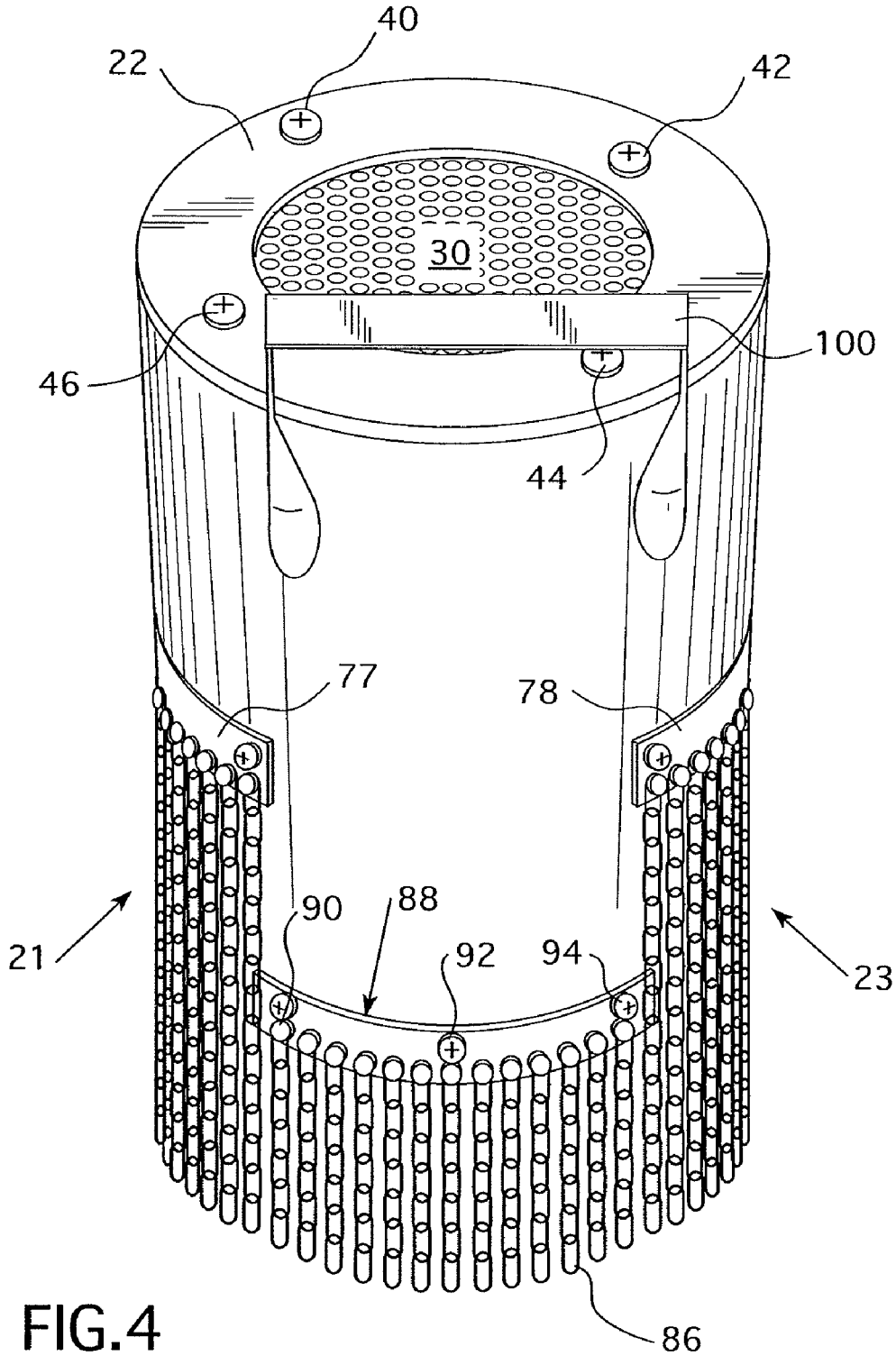
FIG. 4 is a perspective view showing a perspective view of the apparatus of the present invention.

As shown generally, the annular body 20 is substantially hollow. The portion which overlies the rail 5 has downwardly open recesses for receipt of the rail. This recess has an upper edge 52 and a pair of depending lateral edges 54,56, in a portion shown in FIG. 1 and an upper edge 60 and lateral edges 62,64 in the portion shown in FIG. 3. Secured from a portion of the annular body generally overlying the downwardly open recesses 70,72 are two shield sections 21,23 which have, respectively, a first plurality of shield elements 74,76. These may be a plurality of individual elements individually secured to the annular body 20, or to a plate which is secured to the body as in the present case, with reference to plates 77,78 as shown in FIGS. 2, 4 and 5, or these may be prepared as a curtain which is secured as a unit to the annular body 20. It is preferred that the shielding elements be metal chains which provide adequate surface areas and contour to effectively resist passage of flame or sparks out of either of the two downwardly open recesses 70,72. As shown in FIG. 3, the torch entry window 50 is provided.

The chains may, for example, have twisted links or conventional straight links. In the form shown, the first plurality of shield elements 76 has a series of generally parallel downwardly extending chain elements which have lengths such that they extend to the underlying rail, uneven earth or ties. They also form an intimate barrier surrounding the rail 5 to resist passage of sparks or flames between the shield elements and the rail 5 or between the shield elements and the earth and the ties.

Figure 1:
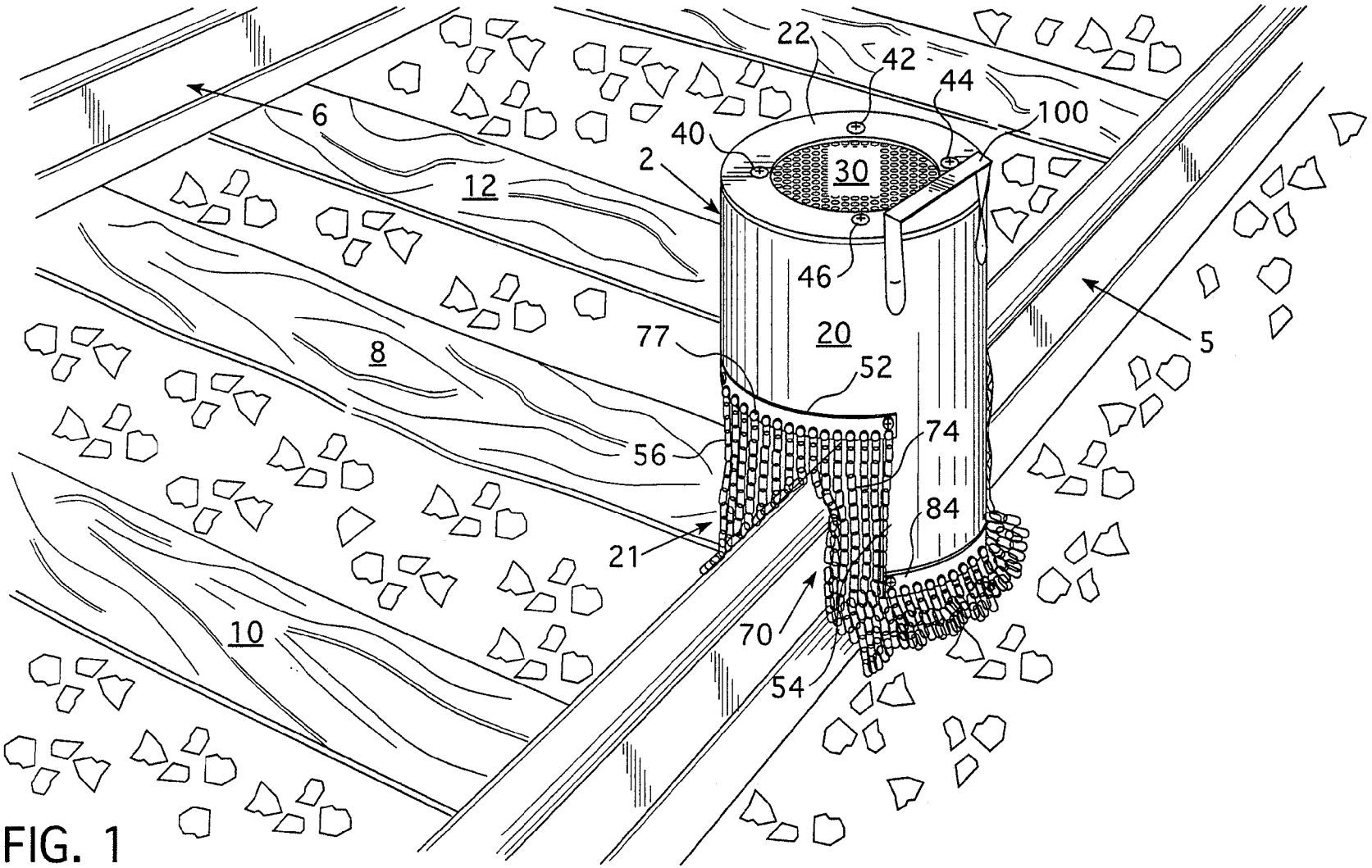
FIG. 1 is a perspective view of the apparatus of the present invention positioned on a metal workpiece which in the form shown is a railroad rail, as viewed from a front position, showing the first plurality of shield elements and a second plurality of shield elements and the upper end wall.
Figure 2:
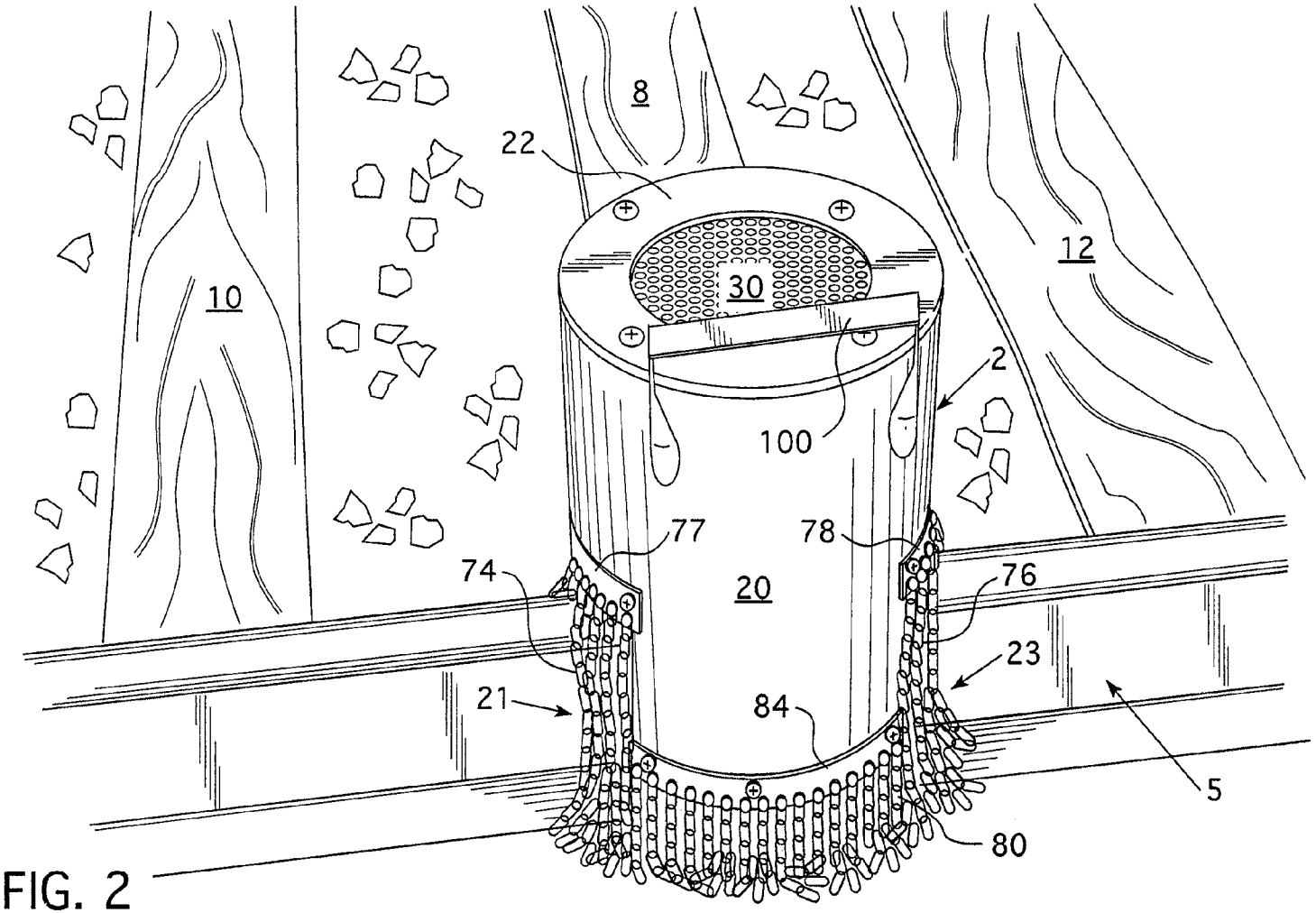
FIG. 2 is a perspective view showing a lateral portion of the apparatus of the present invention with a plurality of second shield elements, portions of the first shield elements and the upper end wall.

Referring to FIGS. 1 and 3, consideration will be given to the two lateral sections disposed circumferentially between recesses 70 and 72. These have a second plurality of shield members 80,86, which in the form shown, are the preferably metal chains. These have been secured, respectively, to plates 84,88, which have been secured by a plurality of screw fasteners, for example, 90,92,94 for plate 88 (FIG. 4) with similar securement being employed for plate 84. The shield members 80,86 have a length such that they will contact the underlying rail portions, soil or ties so as to resist passage or sparks or flames thereunder, as well as therethrough. Both the first plurality of shield elements 74,76 and the second plurality of shield elements 80,86 have the advantage of being flexible so as to assume a custom contour with respect to the underlying adjacent surfaces.

It will be appreciated that in this manner, that substantially continuous circumferential protection is provided in order to resist undesired passage of sparks or flames out of the apparatus during cutting by the cutting torch is achieved. The combination of the two first plurality of shield elements 21,23 and the second series of a plurality of shield elements 80,86 effectively achieves this objective, even though each pair of pluralities has to deal with two different heights of recess in the annular body 20.

It will be noted that, for convenience of transport and positioning, the apparatus has a handle 100 which is secured to body 20 and is structured to be manually engaged by the individual transporting, positioning and moving the apparatus.

FIG. 6 illustrates a bottom plan view of an embodiment of the invention which may be similar to FIG. 1. In FIG. 6 there is provided grill 110 in the upper end wall 24. The grill 110 has a greater area than the circular opening in end wall 24. The grill 110 serves to resist exit of the flames or sparks through the top of the apparatus. A plurality of shield elements, such as 113, 114, 116, 118, for example, are shown in FIG. 7.

Figure 7:
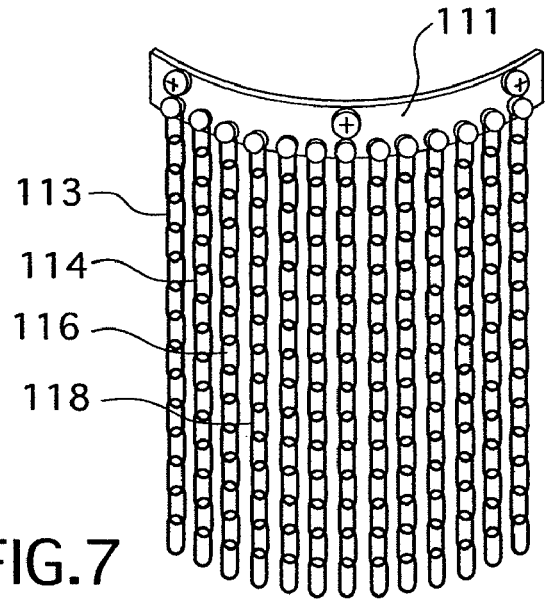
FIG. 7 is a perspective view of the form of array of shield elements employable in the present invention.

Referring to FIGS. 6 and 7, there is seen a type of plate 111 which is securable to the device 20 and has a plurality of shield elements 113,114,116,118 up through n, secured thereto. The total "n" is any desired number of shield elements in a given installation.

It is preferred that the spark arrestor of the present invention be made of a metal selected from the group consisting of steel and stainless steel.

It will be appreciated, therefore, that the present invention has provided an effective, meaningful solution, which in a simple manner greatly reduces or eliminates the safety risk and fire risk involved in processing of railroad rails for purposes of cutting rails for replacement, preheating rails and welding rails.

While for convenience of disclosure, the illustrations and descriptions have focused on spiked rails which are secured in position for cooperating with the railroad ties to provide for the path of movement of a train, the invention is not so limited. It may also be used with unspiked rails which are not spiked to the railroad ties and may be positioned off to the side of the railroad right-of-way.

It will be appreciated that the design of the present invention provides a spark arrestor which is sufficiently light so as to be readily transportable by a workman from operating position to operating position. It is also preferably so designed in terms of weight distribution and contour so as to resist undesired movement due to windy conditions or uneven surfaces underlying the spark arrestor.

It will be appreciated that the present invention may be employed with new construction, as well as salvaging and other operations performed on the rails.

EXAMPLE

A non-limiting example of a currently preferred dimensional range for the shield is as follows. The overall axial height of the shield will be about 15 to 21 inches and the transverse diameter measured on the exterior will be about 9 to 13 inches. The openings for the rails will each be about 6 to 10 inches wide and will have a height of about 6 to 10 inches. The opening at the upper end will be about 6 to 8 inches across. Preferably, two stainless steel mesh grills, such as 30, will be provided in the top opening spaced from each other about ½ inch and having the patterns slightly offset from each other. The torch window 50 (FIG. 3) will preferably be an opening of about 2 to 4 inches wide and 6 to 8 inches high.

Figure 8:
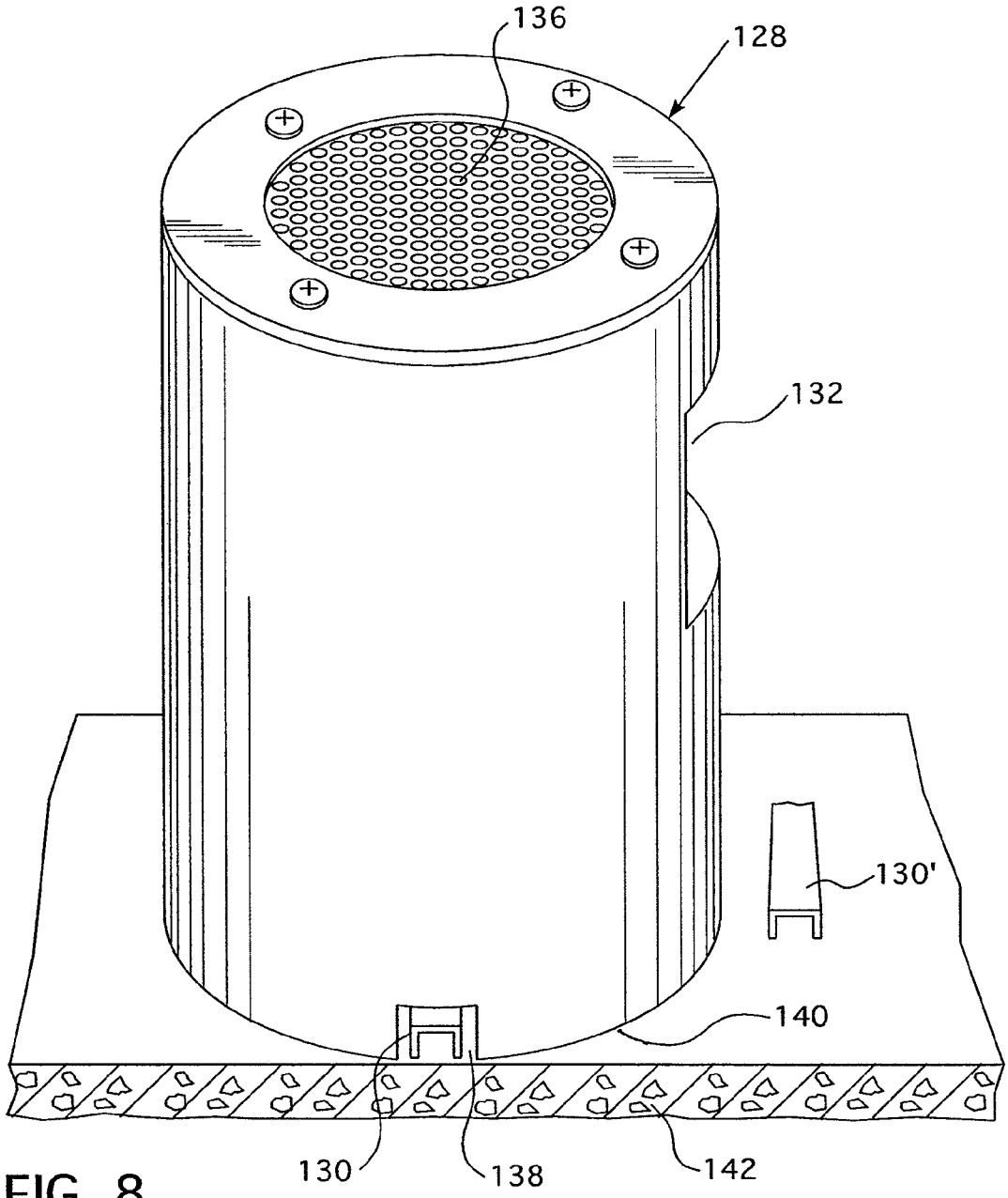
FIG. 8 shows a the spark arrestor of the present invention in a modified version wherein the shielding elements are not employed and the opening for introduction of the torch is placed on the side of apparatus.

In connection with the use of the spark arrestor for metal workpieces other than railroad rails, essentially the same construction as disclosed and illustrated in FIGS. 1 through 7 may be employed for a wide variety of metal workpieces. The dimensioning of the spark arrestor may be altered to accommodate the specific environment, the nature and size of the metal workpiece, the process to be performed on the same and the nature of the environment in which it would be employed. For example, FIG. 8 illustrates by way of example, an extruded inverted elongated metal channel 130 which is to be severed into individual channel elements 130' of a predetermined length by a torch which may be introduced through opening 132, which in this embodiment is positioned on the side of spark arrestor 128. This embodiment is essentially the same as other embodiments except for the use of a smaller opening 138 and the absence of the shielding elements. The supporting floor, table or other work surface on which spark arrestor rests will cooperate with the spark arrestor to resist undesired spark or flame escape underneath the spark arrestor.

As shown in FIG. 8, a grill member 136 is provided on the top of the spark arrestor 128 to permit safe receipt of the metal workpiece and torch. A first portion 130' has been severed from the workpiece. A second portion 130 of the metal workpiece will emerge from opening 138. The lower portion of the spark arrestor 140 is shown resting on a suitable support 142 which could be a table, a floor or other suitable supporting structure. In this embodiment, the shield elements have not been employed as they were not deemed essential to the safety aspects of the process. In general, however, it will be preferred to employ the shield elements shown in FIGS. 1 through 7 or a lesser number as desired. For example, the shield elements 74,76 (FIGS. 1 and 3) may be used without the lateral shield members 80,86 (FIGS. 2 and 4) and vice versa. It will be appreciated that the downwardly open recesses, such as 138 and the corresponding recess diametrically opposed (not shown in this view) have been sized to accommodate the size workpiece with which the spark arrestor will be employed. If desired, however, a variety of metal workpiece dimensions may be employed with the spark arrestor with the use of the shields serving to resist passage of flames and sparks out of the spark arrestor between the workpiece and the vertical edges defining the downwardly open recess 138.

It will be appreciated that the present invention is not limited to railroad rails, but may be employed for a wide variety of operations where a torch presenting a potential flame or spark injury to persons and/or damage to property risk is present. As in FIG. 8, the torch may be employed to severe individual units from an elongaged workpiece or a group of workpieces, such as for example, a plurality of elongated solid steel rods. Also, the torch may be used for cutting openings or recesses in a workpiece, as well as other cutting operations. The torch may be used to preheat a workpiece which will be subejct to subsequent processing.

Whereas particular embodiments of the invention have been described herein for purposes of illustration, it will be appreciated by those skilled in the art that numerous variations of the details may be made without departing from the invention as described in the appended claims.

What is claimed is:

1. A spark arrestor for processing a metal workpiece comprising an annular body having an upper end wall having a first opening and lower end wall having a second opening, and said annular body having a pair of circumferentially offset, generally aligned, downwardly open first recesses structured to receive a portion of said metal workpiece, and said annular body having an opening for receipt of a torch.

2. The spark arrestor of claim 1 including each said first recess having a plurality of downwardly depending first shield elements structured to extend beyond the upper surface of said metal workpiece.

3. The spark arrestor of claim 2 including said downwardly open first recesses having an upper edge portion and two cooperating downwardly extending lateral portions.

4. The spark arrestor of claim 3 including said downwardly open first recesses being structured to overlie said metal workpiece with said first shield elements providing resistance to sparks and flames created within said spark arrestor passing out of said shield.

5. The spark arrestor of claim 3 including said first shield elements being metal chains.

6. The spark arrestor of claim 2 including said annular body having a plurality of second shield elements disposed circumferentially between said downwardly open first recesses.

7. The spark arrestor of claim 6 including said plurality of second shield elements being chains.

8. The spark arrestor of claim 1 including said upper end wall opening having an open grid which will facilitate viewing said torch while resisting exit of sparks and flames therethrough.

9. The spark arrestor of claim 6 including said second shield elements being circumferentially offset from each other.

10. The spark arrestor of claim 2 including said spark arrestor having a handle secured thereto.

11. The spark arrestor of claim 7 including said spark arrestor having a height of about 15 to 21 inches and maximum transverse dimension of about 9 to 13 inches.

12. The spark arrestor of claim 1 including said annular body composed of a material selected from the group consisting of steel and stainless steel.

13. The spark arrestor of claim 6 including said plurality of first shield elements and said plurality of second shield elements structured to cooperate with said spark arrestor body to provide circumferentially substantially continuous shield element protection for resisting exit of sparks and flames from within said spark arrestor.

14. The spark arrestor of claim 6 including said annular body cooperating with said upper end wall and said lower end wall to provide a substantially hollow space therebetween to facilitate freedom of movement of said torch within said spark arrestor.

15. The spark arrestor of claim 1 including said opening for receiving a torch selected from the group consisting of a cutting torch and a pre-heating torch.

* * * * *

UNITED STATES PATENT AND TRADEMARK OFFICE

CERTIFICATE OF CORRECTION

PATENT NO. : 8,286,720 B1
APPLICATION NO. : 13/229882
DATED : October 16, 2012
INVENTOR(S) : Dennis Moyer It is certified that error appears in the above-identified patent and that said Letters Patent is hereby corrected as shown below:

On the Title Page, Item (56), second column, under a heading of FOREIGN PATENT DOCUMENTS, add --JP 2001239369 A 9/2001--.

Signed and Sealed this
Fourteenth Day of May, 2013

Teresa Stanek Rea
*Acting Director of the United States Patent and Trademark Office*